US010530132B2

(12) United States Patent
Hattori et al.

(10) Patent No.: US 10,530,132 B2
(45) Date of Patent: Jan. 7, 2020

(54) SPARK PLUG FOR INTERNAL COMBUSTION ENGINE AND METHOD FOR MANUFACTURING THE SAME

(71) Applicant: DENSO CORPORATION, Kariya, Aichi-pref. (JP)

(72) Inventors: Kenji Hattori, Kariya (JP); Ryuichi Ohno, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/381,089

(22) Filed: Apr. 11, 2019

(65) Prior Publication Data

US 2019/0237941 A1 Aug. 1, 2019

Related U.S. Application Data

(63) Continuation of application No. PCT/JP2017/031407, filed on Aug. 31, 2017.

(30) Foreign Application Priority Data

Oct. 12, 2016 (JP) ..... 2016-200845

(51) Int. Cl.
*H01T 13/32* (2006.01)
*H01T 21/02* (2006.01)
*H01T 13/08* (2006.01)

(52) U.S. Cl.
CPC ..... *H01T 13/32* (2013.01); *H01T 13/08* (2013.01); *H01T 21/02* (2013.01)

(58) Field of Classification Search
CPC ..... H01T 13/32; H01T 21/02; H01T 13/08
See application file for complete search history.

(56) References Cited

U.S. PATENT DOCUMENTS

| | | | | |
|---|---|---|---|---|
| 5,373,214 | A | 12/1994 | McCready | |
| 5,998,912 | A | 12/1999 | Schwab | |
| 2007/0290592 | A1 | 12/2007 | Lykowski | |
| 2007/0290595 | A1 | 12/2007 | Lykowski | |
| 2007/0290596 | A1 | 12/2007 | Lykowski | |
| 2010/0213812 | A1 | 8/2010 | Kawashima et al. | |
| 2010/0289397 | A1 | 11/2010 | Hanashi et al. | |
| 2011/0210659 | A1 | 9/2011 | Suzuki et al. | |
| 2011/0316408 | A1* | 12/2011 | Suzuki | H01T 13/20 313/141 |

(Continued)

OTHER PUBLICATIONS

ISR WO2018070129 machine translation (Year: 2017).*

*Primary Examiner* — Tracie Y Green
(74) *Attorney, Agent, or Firm* — Nixon & Vanderhye P.C.

(57) ABSTRACT

A spark plug includes: a cylindrical mounting bracket attachable to an internal combustion engine; a center electrode that is held by the mounting bracket in an insulated manner and has a first end portion exposed and extended from a first end portion of the mounting bracket; a ground electrode that has a first end side joined to the first end portion of the mounting bracket and has a surface of the second end side extended to be opposed to the first end portion of the center electrode; a convex portion that protrudes from a base material of the ground electrode on the surface of the ground electrode toward the center electrode, has a surface protruded outward, and has surfaces without corners; and a precious metal layer formed on the surface of the convex portion.

7 Claims, 12 Drawing Sheets

(56) References Cited

U.S. PATENT DOCUMENTS

| | | | | |
|---|---|---|---|---|
| 2012/0112619 | A1* | 5/2012 | Kasuya | H01T 13/32<br>313/141 |
| 2012/0146483 | A1* | 6/2012 | Kadowaki | H01T 13/39<br>313/141 |
| 2012/0190266 | A1 | 7/2012 | Hanashi et al. | |

* cited by examiner

CONSUMPTION AMOUNT: CAPACITY > INDUCTION

SPARK PLUG FOR INTERNAL COMBUSTION ENGINE AND METHOD FOR MANUFACTURING THE SAME

CROSS-REFERENCE TO RELATED APPLICATION

This application is a continuation application of International Application No. PCT/JP2017/031407 filed Aug. 31, 2017 which designated the U.S. and claims priority to Japanese Patent Application No. 2016-200845 filed on Oct. 12, 2016, the contents of which are incorporated herein by reference.

TECHNICAL FIELD

The present disclosure relates to a spark plug for an internal combustion engine used in an engine of an automobile and other equipment, and a method for manufacturing the same.

BACKGROUND

There has been conventionally known a configuration of a spark plug in which a convex portion is provided on an opposed surface of a ground electrode as a surface on a center electrode side by forming a convexity on part of a base material of the ground electrode to protrude toward the center electrode.

SUMMARY

The present disclosure is a spark plug that includes: a cylindrical mounting bracket attachable to an internal combustion engine; a center electrode that is held by the mounting bracket in an insulated manner and has a first end portion exposed and extended from a first end portion of the mounting bracket; a ground electrode that has a first end side joined to the first end portion of the mounting bracket and has a surface of a second end side extended to be opposed to the first end portion of the center electrode; a convex portion that protrudes from a base material of the ground electrode on the surface of the ground electrode facing the center electrode, has a surface protruded outward, and has surfaces without corners; a precious metal layer formed on a surface of the convex portion; and a shape of the convex portion satisfies $h/r \leq 1.3$ where h represents a height of the ground electrode from the surface to the convex portion as seen in a protrusion direction, and r represents a maximum length from a center of gravity to an edge end of a cross section of the convex portion on the surface.

DETAILED DESCRIPTION OF THE PREFERRED EMBODIMENTS

Figure 1:
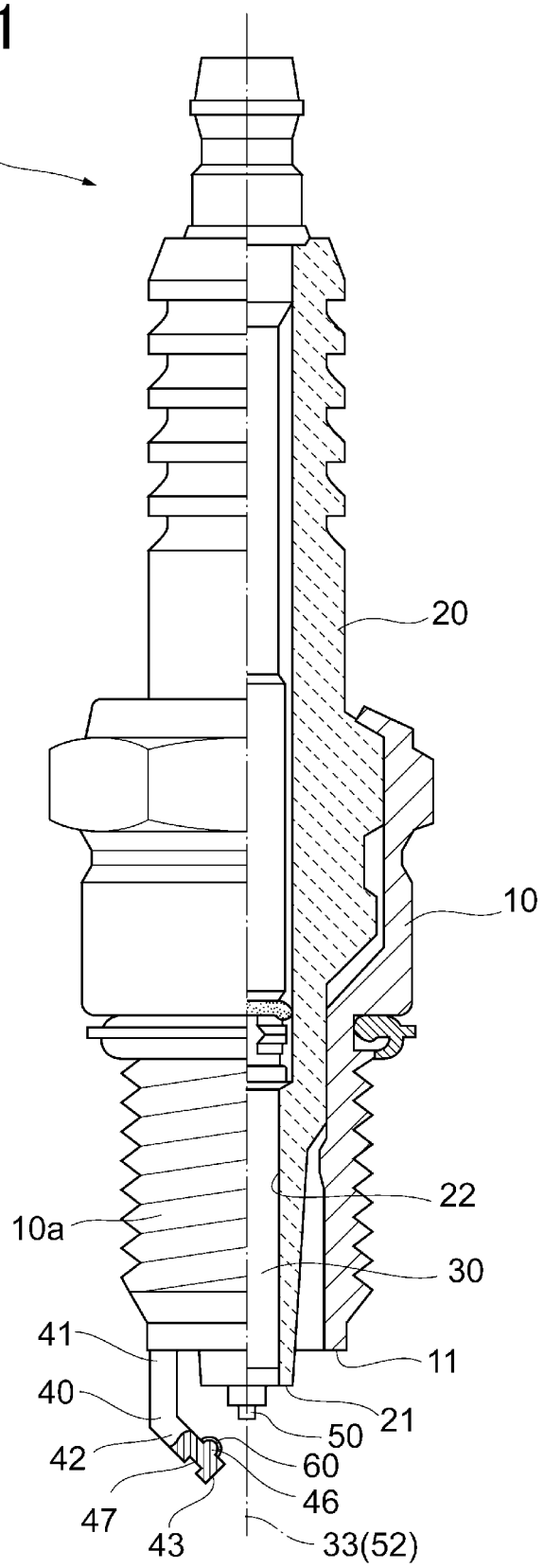
FIG. 1 is a semi-cross-sectional view of a spark plug according to an embodiment.

According to the known configuration of a spark plug, a precious metal layer can be provided on a discharge surface as a tip surface of the convex portion by welding a precious metal chip to a portion of the base material of the ground electrode where the discharge surface as the tip surface of the convex portion is to be formed to form a fuse solidification portion by fusing with the base material, and then forming the convex portion by extrusion molding. In addition to the tip surface, a precious metal layer can be provided by the same processing method on the side surfaces and corners between the tip surface and the side surfaces of the convex portion. Covering most of the convex portion with a precious metal layer makes it possible to suppress wear from occurring on the corners that are likely to be worn due to discharge and avoid defects such as oxidation, cracking, and peeling of the fuse solidification portion.

In recent supercharged engines and high EGR engines, the flow rate of an air-fuel mixture in the combustion chamber has been increased to flow moderately the air current into a spark discharge gap in the spark plug so that the spark tends to be extended. Accordingly, there is a high possibility that the ground-side origin point of the extended spark moves up to the side surfaces of the convex portion.

According to the foregoing processing method by which the precious metal layer is provided on the surface of the convex portion, the portions of the precious metal chip corresponding to the corners and side surfaces of the convex portion are extended along with the formation of the convex portion, and thus the precious metal layer on the corners and side surfaces of the convex portion becomes thinner than that on the tip surface. Accordingly, in recent application environments of spark plugs, the consumable life of the precious metal layer on the side surfaces and corners of the convex portion is particularly shortened so that the base material of the ground electrode may be exposed immediately. With the likelihood of exposure of the base material, the base material may be more greatly consumed or the precious metal layer may come off from the base material.

An object of the present disclosure is to provide a spark plug that suppresses wear from occurring on a precious metal layer on a ground electrode to preferably prevent the exposure of a base material of the ground electrode.

The present disclosure is a spark plug that includes: a cylindrical mounting bracket attachable to an internal combustion engine; a center electrode that is held by the mounting bracket in an insulated manner and has a first end portion exposed and extended from a first end portion of the mounting bracket; a ground electrode that has a first end side joined to the first end portion of the mounting bracket and has a surface of a second end side extended to be opposed to the first end portion of the center electrode; a convex portion that protrudes from a base material of the ground electrode on the surface of the ground electrode facing the center electrode, has a surface protruded outward, and has surfaces without corners; and a precious metal layer formed on a surface of the convex portion, and a shape of the convex portion satisfies $h/r \leq 1.3$ where h represents a height of the ground electrode from the surface to the convex portion as seen in a protrusion direction, and r represents a maximum length from a center of gravity to an edge end of a cross section of the convex portion on the surface.

According to this configuration, the thickness of the precious metal layer can be made approximately uniform regardless at what position the precious metal layer is located on the surface of the convex portion. Accordingly, it is possible to preferably avoid the precious metal layer from being locally worn even in recent application environments of spark plugs such as supercharged engines or high EGR engines in which the flow rate of an air-fuel mixture in the combustion chamber is high, a spark generated in a spark discharge gap in the spark plug is greatly extended, the amount of movement of the origin point of the spark on the side of a ground electrode tends to be large.

According to the present disclosure, it is possible to provide a spark plug that preferably suppresses wear from occurring on the precious metal layer in the ground electrode to prevent the exposure of the base material of the ground electrode, and a method for manufacturing the same.

An embodiment will be described below with reference to the attached drawings. For easy understanding of the description, identical components in the drawings are given identical reference signs as much as possible and duplicated descriptions thereof will be omitted.

A configuration of a spark plug 100 according to the present embodiment will be described with reference to FIGS. 1 to 4. The spark plug 100 according to the present embodiment is applied to an ignition plug of an automobile engine or the like, and is inserted into and fixed to a screw hole provided in an engine head (not illustrated) which defines and forms a combustion chamber of the engine.

As illustrated in FIG. 1, the spark plug 100 has a cylindrical mounting bracket 10 formed of a conductive steel material (for example, low-carbon steel or the like), and the mounting bracket 10 includes a mounting screw portion 10*a* for fixing the spark plug 100 to an engine block not illustrated. An insulator 20 made of alumina ceramic ($Al_2O_3$) or the like is fixed to the inside of the mounting bracket 10 so that a first end portion 21 of the insulator 20 is exposed from a first end portion 11 of the mounting bracket 10.

Figure 2:
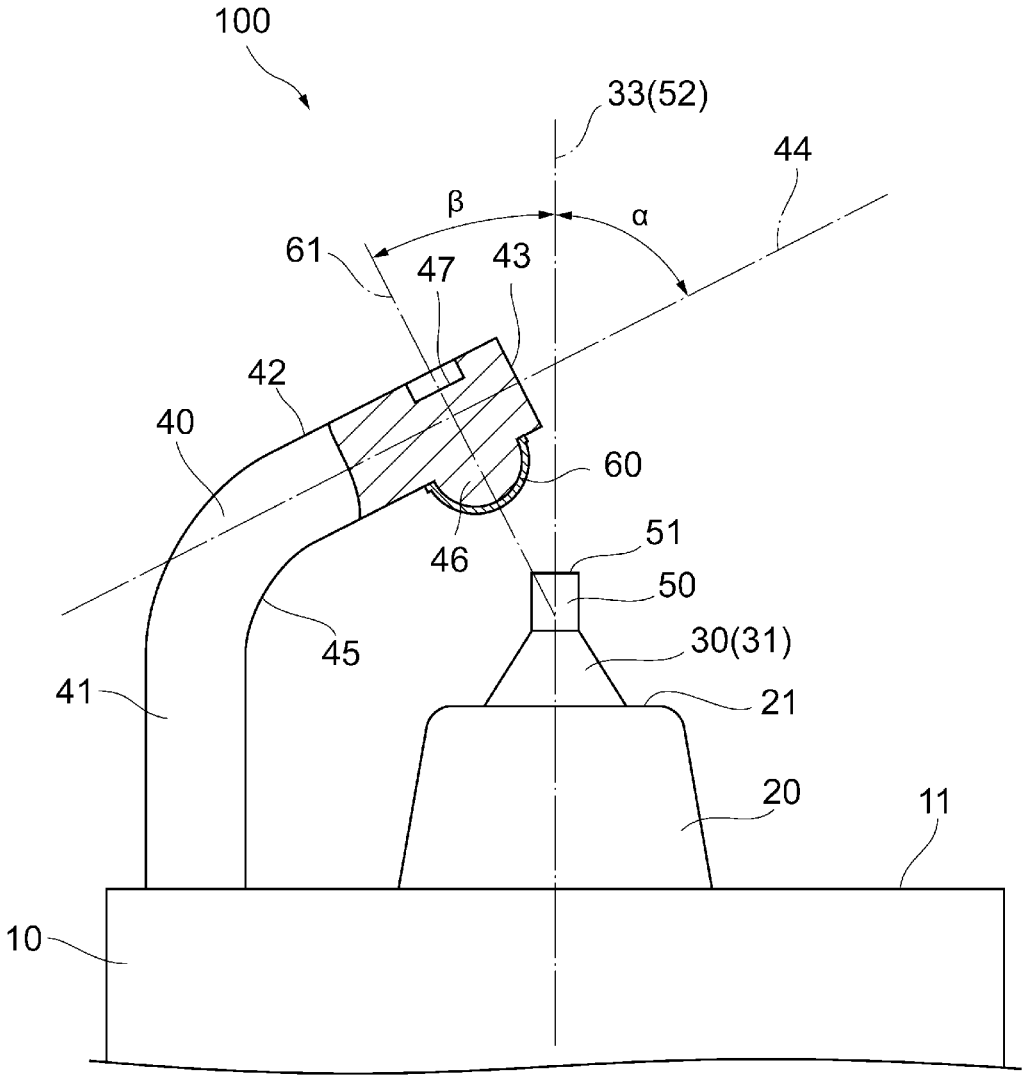
FIG. 2 is an enlarged view of a spark discharge part and its vicinity in the spark plug illustrated in FIG. 1.

A center electrode 30 is fixed to an axial hole 22 of the insulator 20 and is held with respect to the mounting bracket 10 in an insulated manner. The center electrode 30 is a columnar body in which an inner material is made of a metallic material such as Cu excellent in heat conductivity and an outer material is formed of a metallic material such as a Ni base alloy excellent in heat resistance and corrosion resistance. As illustrated in FIG. 2, the center electrode 30 has a first end portion 31 decreased in diameter and exposed, and is extended from the first end portion 21 of the insulator 20.

On the other hand, a ground electrode 40 has a pillar shape (for example, prismatic shape) that is fixed at a first end portion 41 by welding to the first end portion 11 of the mounting bracket 10, bent in the middle, and extended on the side of a second end portion 42 toward the first end portion 31 of the center electrode 30 to form an acute angle with an axis 33 of the center electrode.

That is, as illustrated in FIG. 2, an angle $\alpha$ formed by an axis 44 of the ground electrode 40 directed to an end surface 43 on the second end portion 42 side (hereinafter, called a ground electrode second end surface) and the axis 33 of the center electrode 30 is an acute angle. Specifically, the ground electrode 40 has a slant shape, that is, a shape slanting with respect to the center electrode 30 as seen in an extension direction. The ground electrode 40 is made of an Ni base alloy with Ni as the main ingredient, for example.

The axis 44 of the ground electrode 40 toward the ground electrode second end surface 43 is an axis that extends toward the substantial ground electrode second end surface 43 of the ground electrode 40 is projected onto a virtual plane when assuming a plane including the center of gravity of a cross section of a joint portion (welded portion) between the ground electrode 40 and the mounting bracket 10 and the axis 33 of the center electrode as the virtual plane. The virtual plane is a plane parallel to the surface of FIG. 2.

A center electrode-side chip 50 made of a precious metal or the like and extending in the same direction as the axis 33 of the center electrode is joined to the first end portion 31 of the center electrode 30 by laser welding, resistance welding, or the like. That is, in the present embodiment, the axis 33 of the center electrode is also an axis 52 of the center electrode-side chip 50. In this example, the axis 33 of the central axis aligns with the axis 52 of the center electrode-side chip. However, these axes may not align with each other but may extend in the same direction, that is, may be in a parallel relationship.

On the other hand, a convex portion 46 is formed on one surface 45 of the ground electrode 40 on the second end portion 42 side opposed to the center electrode 30 (hereinafter, called "opposed surface 45") to protrude from the base material of the ground electrode 40 toward the center electrode 30. The convex portion 46 is shaped to have a surface protruded outward and has surfaces without corners. In the present embodiment, the convex portion 46 has a tip formed in a hemispherical shape. A precious metal layer 60 of a substantially even thickness is formed on the convex portion 46 to cover the entire surface of the convex portion 46. The precious metal layer 60 is also a fuse solidification portion formed by fusing a precious metal chip and part of the base material of the ground electrode 40. In the present embodiment, the precious metal layer 60 has a thickness within a range of 0.1 to 0.2 mm.

The convex portion 46 and the precious metal layer 60 extend toward a tip surface 51 of the center electrode-side chip 50 such that the tip and the tip surface 51 of the center electrode-side chip 50 are opposed to each other with a discharge gap therebetween. Hereinafter, as illustrated in FIG. 2, an axis of the convex portion 46 along a protrusion direction of the convex portion 46 and the precious metal layer 60 will be called "axis 61 of the convex portion 46 of the ground electrode 40").

A concave portion 47 is formed on a surface of the ground electrode 40 opposite to the opposed surface 45 to extend from this surface toward the opposed surface 45. The concave portion 47 is formed at a position where the axis 61 of the convex portion 46 passes through, for example. The concave portion 47 is formed to have the same circular shape as that of the convex portion 46 as seen from the direction of the axis 61, for example. In the example of FIG. 2, the concave portion 47 is arranged at a position where its axis aligns with the axis 61 of the convex portion 46.

The axis 52 of the center electrode-side chip and the axis 61 of the convex portion 46 of the ground electrode 40 are in a crossing or distorted positional relationship. Specifically, a crossing angle β between the axis 52 of the center electrode-side chip and the axis 61 of the convex portion 46 of the ground electrode 40 (in a case where the axes are distorted, the crossing angle is as indicated by β in FIG. 2) is preferably 5° to 70° inclusive.

The center electrode-side chip 50 may be formed in a columnar or disc shape but is preferably formed in a columnar shape.

The material for the center electrode-side chip 50 and the precious metal layer 60 of the ground electrode 40 may be any one of alloys such as Pt (platinum)-Ir (iridium), Pt—Rh (rhodium), Pt—Ni (nickel), Ir—Rh, Ir—Y (yttrium), and others.

Further, the material for the center electrode-side chip 50 and the precious metal layer 60 of the ground electrode 40 may be an alloy in which Pt as the main ingredient is mixed with at least one of Ir, Ni, Rh, W, Pd, Ru, and Os. More specifically, the material may be an alloy in which Pt as the main ingredient is mixed with at least one of Ir of 50 weight % or less, Ni of 40 weight % or less, Rh of 50 weight % or less, W of 30 weight % or less, Pd of 40 weight % or less, Ru of 30 weight % or less, and Os of 20 weight % or less.

In addition, the material for the center electrode-side chip 50 and the precious metal layer 60 of the ground electrode 40 may be an alloy in which Ir as the main ingredient is mixed with at least one of Rh, Pt, Ni, W, Pd, Ru, and Os. More specifically, the material may be an alloy in which Ir as the main ingredient is mixed with at least one of Rh of 50 weight % or less, Pt of 50 weight % or less, Ni of 40 weight % or less, W of 30 weight % or less, Pd of 40 weight % or less, Ru of 30 weight % or less, and Os of 20 weight % or less.

In the thus configured spark plug 100, electric discharge takes place in a discharge gap formed between the tip surface 51 of the center electrode-side chip 50 and the precious metal layer 60 of the ground electrode 40 to ignite the fuel-air mixture in the combustion chamber. After the ignition, a flame kernel formed in the discharge gap grows to cause combustion in the combustion chamber.

Figure 3:
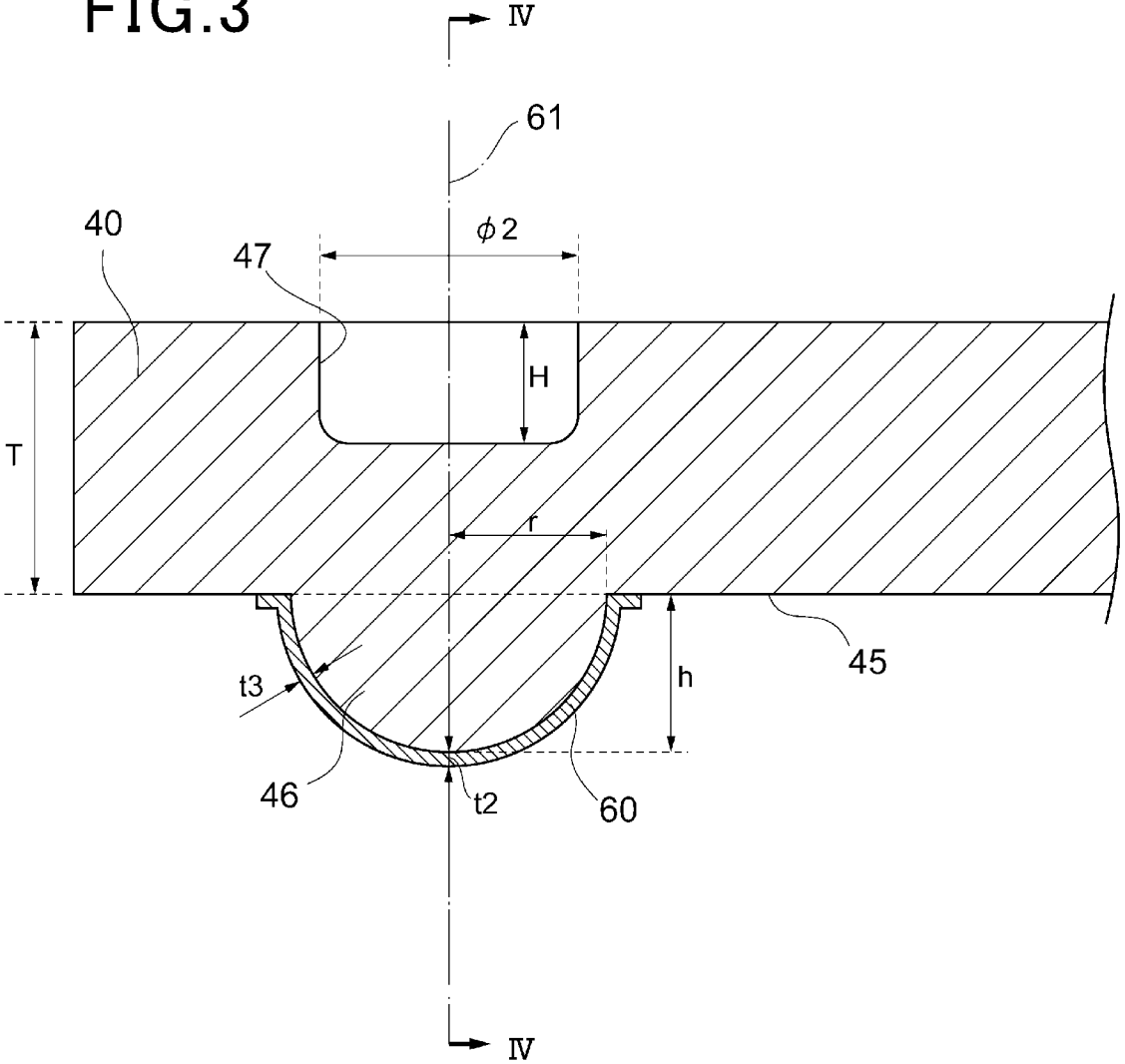
FIG. 3 is a diagram schematically illustrating a shape of a convex portion and its vicinity of a ground electrode.
Figure 4:
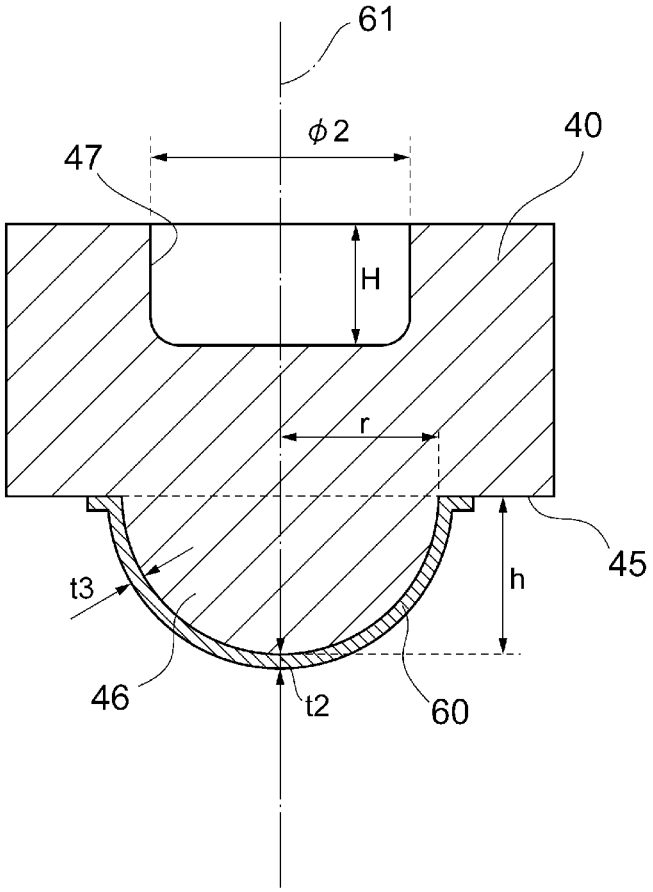
FIG. 4 is a cross-sectional view of FIG. 3 taken along line IV-IV.

In the present embodiment, particularly, as illustrated in FIGS. 3 and 4, the shape of the convex portion 46 preferably satisfies $h/r \leq 1.3$ where h represents the height of the ground electrode 40 from the opposed surface 45 to the convex portion 46 as seen in the protrusion direction, and r represents the maximum length from the center of gravity to the edge end of the cross section of the convex portion 46 on the opposed surface 45 (the radius of a cross-sectional circle in the present embodiment). The shape of the convex portion 46 satisfying this condition is a cylinder with a hemispherical tip, for example.

Further, in the present embodiment, the shape of the convex portion 46 preferably satisfies $h/r \leq 1.0$. The shape of the convex portion 46 satisfying this condition is a hemisphere, for example.

The precious metal layer 60 is preferably formed to satisfy $t3/t2 \geq 0.6$ where t2 represents the thickness (maximum thickness) of the precious metal layer 60 at a minimum gap portion between the convex portion 46 of the ground electrode 40 and the center electrode 30, and t3 represents the minimum thickness of the precious metal layer 60. Further, the precious metal layer 60 is preferably formed to satisfy $t3/t2 \leq 0.9$.

Next, a method for manufacturing the convex portion 46 of the ground electrode 40 and the precious metal layer 60 will be described with reference to FIGS. 5 and 6.

First, a precious metal chip 60*a* as a raw material of the precious metal layer 60 is placed at a position where the convex portion 46 is to be formed on the opposed surface 45 of the base material of the ground electrode 40, and the entire precious metal in the precious metal chip 60*a* and part of the base material of the ground electrode 40 are fused together by resistance welding or arc welding to form a fuse solidification portion. In arc welding, the metal ratio in the surface (discharge surface) of the fuse solidification portion and its vicinity is preferably 70% or more, and the metal ratio in the base material and its vicinity is preferably 50% or less. Examples of arc welding include plasma arc welding, shielded arc welding, submerged arc welding, inert gas welding, MAG welding (including $CO_2$ gas arc welding), and self-shielded arc welding, and others. This fusion processing can also be expressed as processing for bonding the precious metal layer 60 to one surface of the ground electrode 40 (the opposed surface 45) (bonding step).

Figure 5:
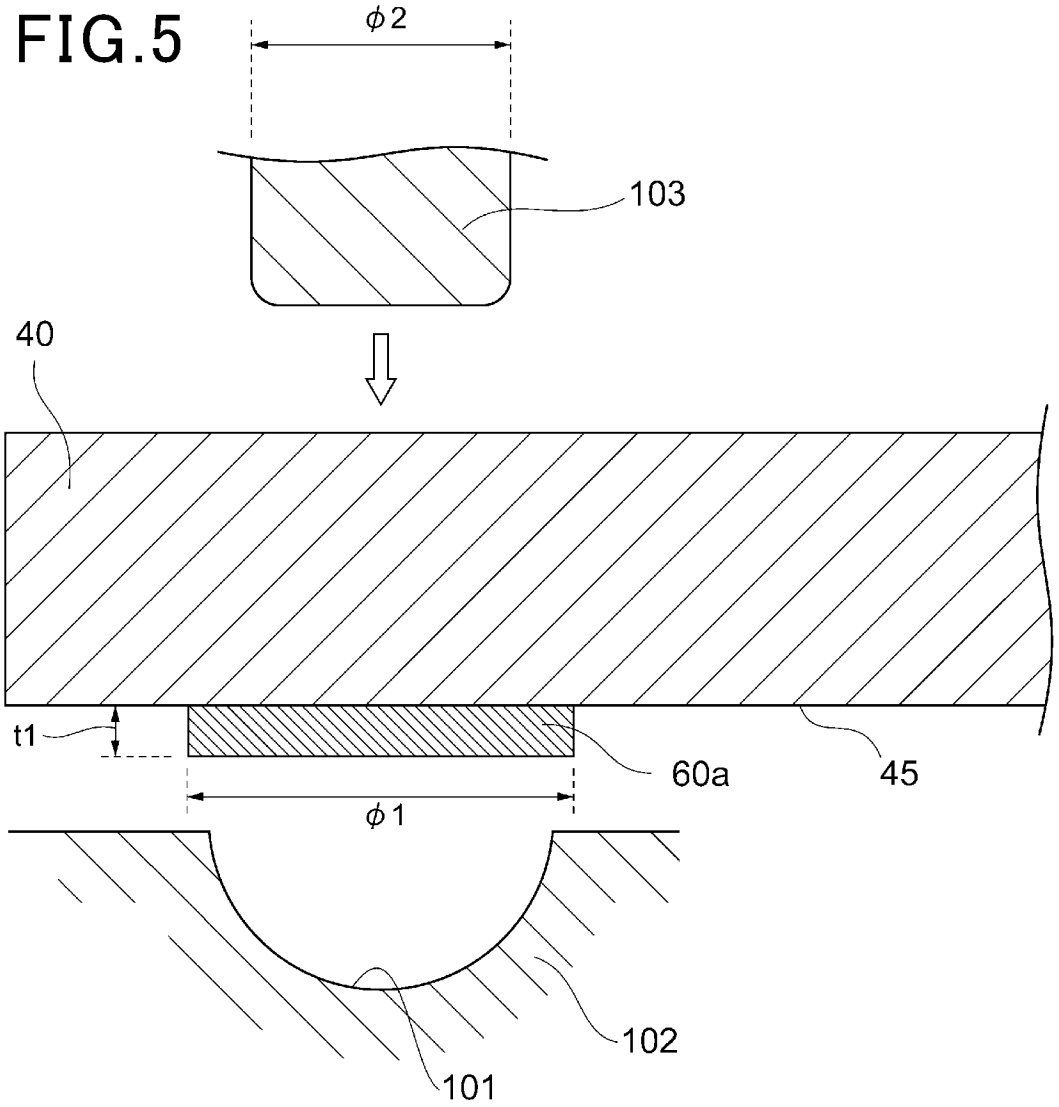
FIG. 5 is a diagram illustrating a pre-extrusion molding state of a convex portion and a precious metal layer of the ground electrode.
Figure 6:
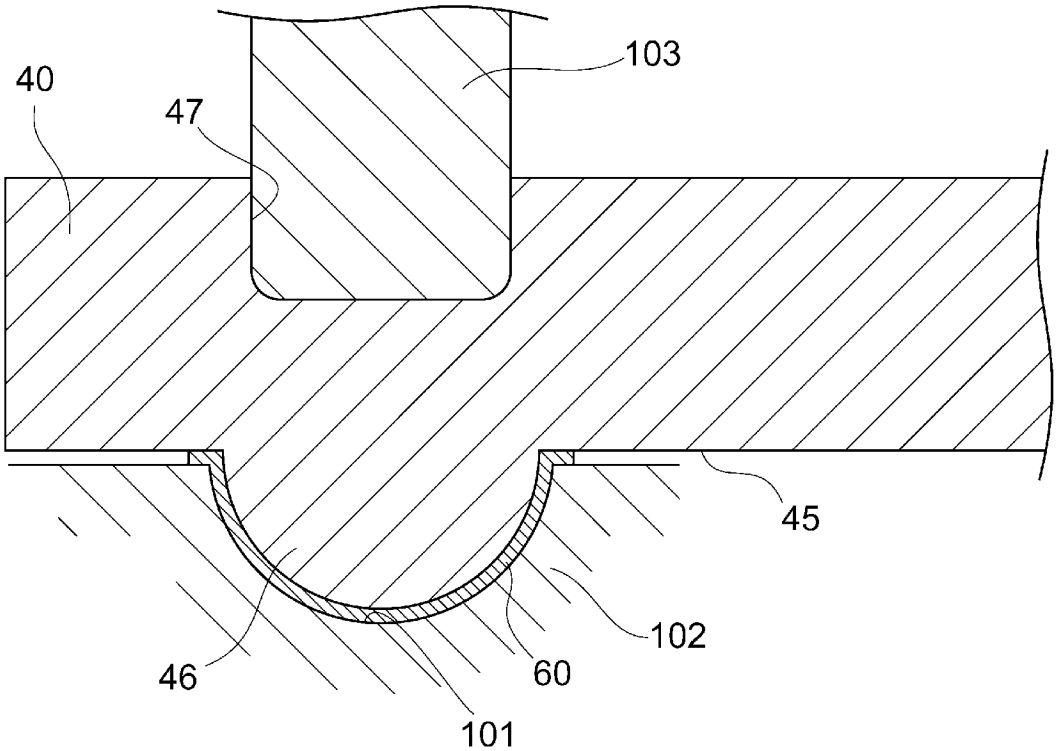
FIG. 6 is a diagram illustrating a post-extrusion molding state of the convex portion and the precious metal layer of the ground electrode.

Then, as illustrated in FIG. 5, the ground electrode 40 with the precious metal chip 60*a* welded is placed on a metal die 102 with an approximately hemispheric cavity 101 for forming the convex portion 46 in a state where the cavity 101 and the opposed surface 45 are opposed to each other. By changing the depth and radius of the cavity 101 for convex portion, a protrusion amount h and a radius r of the completed convex portion 46, and a maximum thickness t2 and a minimum thickness t3 of the molded precious metal layer 60 can be altered.

In the present embodiment, the precious metal chip 60*a* is an approximately circular plate material because the convex portion 46 to be covered with the precious metal layer 60 after the molding has a hemispheric shape. A diameter φ1 of the precious metal chip 60*a* is preferably larger than the diameter of the cavity 101 for convex portion (that is, the maximum diameter of the molded convex portion 46), and the thickness t1 of the precious metal chip 60*a* is preferably larger than or identical to the maximum thickness t2 of the molded precious metal layer 60.

A pressing jig 103 has an approximately columnar shape, for example. The pressing jig 103 is configured such that a diameter φ2 is smaller than the diameter φ1 of the precious metal chip 60*a* and the maximum diameter of the molded convex portion 46 so that the base material is prone to protrude toward the deepest portion of the cavity 101.

The metal die 102 and the pressing jig 103 are used to perform cold-hammer forging on the flat plate-shaped ground electrode 5 to form the convex portion 46 (convex portion forming step). Specifically, as illustrated in FIG. 6, the pressing jig 103 is used to press the opposed surface 45 and part of the rear surface on the opposite side of the ground electrode 40 to form the concave portion 47, and extruded part of the base material of the ground electrode 40 toward the cavity 101 for convex portion to form the convex portion 46. That is, part of the opposed surface 45 is extruded, and the extruded ground electrode 40 is protruded by the extrusion toward the inside of the cavity 101 for convex portion to form the convex portion 46 with the precious metal layer 60 provided on the entire surface as described above (precious metal layer forming step).

As a result, as illustrated in FIGS. 3 and 4, the convex portion 46 with the protrusion amount h, the maximum radius r, and the hemispheric tip is formed on the surface 45 side of the base material of the ground electrode 40 with a thickness T. In addition, the concave portion 47 with the diameter φ2 and the depth H is formed on the surface of the ground electrode 40 opposite to the surface 45. At this time, the extrusion molding is preferably performed such that the axis of the metal die 102 for extrusion molding and the axis 61 of the convex portion 46 to be formed align with each other. This makes it easy to form the hemispheric shape of the convex portion 46.

Since the convex portion 46 has the surface protruded outward and has surfaces without corners (the hemispheric shape in the present embodiment), at the time of the extrusion molding, the precious metal chip 60*a* is entirely extended in an approximately uniform manner along with the protrusion of the base material of the ground electrode 40. Accordingly, the thickness of the molded precious metal layer 60 becomes approximately uniform regardless of the position on the surface of the convex portion 46. That is, it is possible to decrease the difference between the maximum thickness t2 and the minimum thickness t3 of the precious metal layer 60 illustrated in FIGS. 3 and 4. Further, forming the convex portion in a hemispheric shape further decreases the difference between the thicknesses t2 and t3 of the precious metal layer 60.

Next, advantageous effects of the spark plug 100 according to the present embodiment will be described.

The spark plug 100 in the present embodiment includes: the cylindrical mounting bracket 10 attachable to an internal combustion engine; the center electrode 30 that is held by the mounting bracket 10 in an insulated manner and has the first end portion 31 exposed and extended from the first end portion 11 of the mounting bracket 10; the ground electrode 40 that has the first end side joined to the first end portion 11 of the mounting bracket 10 and has the surface 45 of the second end side extended to be opposed to the first end portion 31 of the center electrode 30; the convex portion 46 that protrudes from the base material of the ground electrode 40 on the surface 45 of the ground electrode 40 toward the center electrode 30, has the surface protruded outward, and has surfaces without corners; and the precious metal layer 60 formed on the surface of the convex portion 46. More specifically, the convex portion 46 of the ground electrode 40 is formed by protruding part of the base material of the ground electrode 40 by extrusion molding, and the precious metal layer 60 is welded to the surface 45 of the ground electrode 40 and then formed by extrusion molding on the entire surface of the convex portion 46.

Conventionally, when the precious metal layer 60 is to be formed by extrusion molding on the surface of the convex portion 46 of the ground electrode 40, if the shape of the convex portion is a column or a prism, the portion of the precious metal layer positioned more outside than the corners of the tip surface of the convex portion is more strongly stretched than the portion of the precious metal layer on the tip surface at the time of extrusion molding. Accordingly, the thickness of the precious metal layer tends to be smaller on the corners and side surfaces than on the tip surface of the convex portion. In contrast to this, in the present embodiment, according to the foregoing configuration, the convex portion 46 on which the precious metal layer 60 is to be stretched has no corners and thus the thickness of the precious metal layer 60 can be made approximately uniform regardless of the position on the surface of the convex portion 46. Accordingly, it is possible to avoid preferably the precious metal layer 60 from being locally worn even in recent application environments of spark plugs such as supercharged engines or high EGR engines in which the flow rate of an air-fuel mixture in the combustion chamber is high, a spark generated in the spark discharge gap in the spark plug 100 is greatly extended, and the amount of movement of the origin point of the spark on the side of the ground electrode 40 tends to be large. As a result, it is possible to suppress the precious metal layer 60 in the ground electrode 40 from wearing to preferably prevent exposure of the base material of the ground electrode 40. Since the base material of the ground electrode 40 is not exposed, it is possible to suppress consumption of the base material and prevent shortening of the consumable life of the spark plug, and eliminate concern of the precious metal layer 60 detaching from the base material of the ground electrode 40.

In the spark plug 100 of the present embodiment, the shape of the convex portion 46 preferably satisfies $h/r \leq 1.3$ where h represents the height of the ground electrode 40 from the surface 45 to the convex portion 46 as seen in the protrusion direction, and r represents the maximum length from the center of gravity to the edge end of the cross section of the convex portion 46 on the surface 45 (the radius of a cross-sectional circle in the present embodiment).

According to this configuration, the life time of the ground electrode 40 in the spark plug 100 can be maintained in a favorable state and the shortening of the consumable life of the spark plug can be preferably prevented. As a result, it is possible to suppress the precious metal layer 60 in the ground electrode 40 from wearing and preferably prevent the exposure of the base material of the ground electrode 40. The grounds for producing this advantageous effect by the setting within the foregoing numerical range will be described later with reference to FIG. 7.

In the spark plug 100 of the present embodiment, the shape of the convex portion 46 further preferably satisfies $h/r \leq 1.0$.

According to this configuration, the uniformity of the thickness of the precious metal layer 60 can be further improved. Since the precious metal layer 60 does not have any extremely thin portion, it is possible to further reduce the risk of exposure of the base material of the ground electrode 40. Therefore, it is possible to further suppress the precious metal layer 60 in the ground electrode 40 from wearing and further prevent exposure of the base material of the ground electrode 40. The grounds for producing this advantageous effect by the setting within the foregoing numerical range will be described later with reference to FIG. 7.

In the spark plug 100 of the present embodiment, the tip of the convex portion 46 of the ground electrode 40 has a hemispheric shape. According to this configuration, the point of origin of a spark generated in the spark discharge gap in the spark plug 100 on the ground electrode 40 side moves over the entire surface of the convex portion 46, which makes it possible to make the consumption of the precious metal layer 60 due to discharge even more uniform, and lengthen the consumable life of the spark plug 100.

In the spark plug 100 of the present embodiment, the precious metal layer 60 is formed to satisfy $t3/t2 \geq 0.6$ where t2 represents the thickness of the precious metal layer 60 in the minimum gap portion between the convex portion 46 of the ground electrode 40 and the center electrode 30, and t3 represents the minimum thickness of the precious metal layer 60. According to this configuration, it is possible to ensure at least minimal uniformity of the thickness of the precious metal layer 60 and preferably prevent the shortening of the consumable life of the spark plug 100.

Next, the grounds for setting the shape of the convex portion 46 of the ground electrode 40 within the range of h/r≤1.3, more preferably within the range of h/r≤1.0 will be provided with reference to FIGS. 7 to 10.

First, the grounds for setting the shape of the convex portion 46 of the ground electrode 40 within the range of h/r≤1.0 will be described with reference to FIG. 7. This condition is derived from the results of a uniformity evaluation test on the precious metal layer 60 in the ground electrode 40 of the spark plug 100 under the following specifications:

- Thickness T of the base material of the ground electrode 40: fixed to 1.3 mm
- Width of the base material of the ground electrode 40 (the dimension as seen in the depth direction illustrated in FIG. 3): fixed to 2.6 mm
- Thickness t1 of the precious metal chip 60*a* before extrusion molding (see FIG. 5): fixed to 0.15 mm
- Diameter φ1 of the precious metal chip 60*a* before extrusion molding (see FIG. 5): fixed to 1.2 mm
- Height of the convex portion 46: 0.3, 0.5, 0.7, and 1.0 mm
- Radius r of the convex portion 46: five values different in h/r for the individual heights h
- Push-in depth of the pressing jig 103 (the depth H of the concave portion 47 (see FIG. 3): changed as appropriate according to the height h of the convex portion 46
- Diameter φ2 of the pressing jig 103: changed as appropriate according to the radius r of the convex portion 46

At the evaluation test, in setting the push-in amounts H of the pressing jig 103 to ensure the foregoing four heights h, five convex cavities 101 with different diameters were used to provide five different radiuses r of the convex portion 46. That is, the convex portions 46 and the precious metal layers 60 were formed in the four heights h×the five radiuses r=the total 20 settings. Then, the film thickness ratio t3/t2 of the precious metal layer 60 prepared in each of the settings was measured as evaluation characteristic value.

Figure 7:
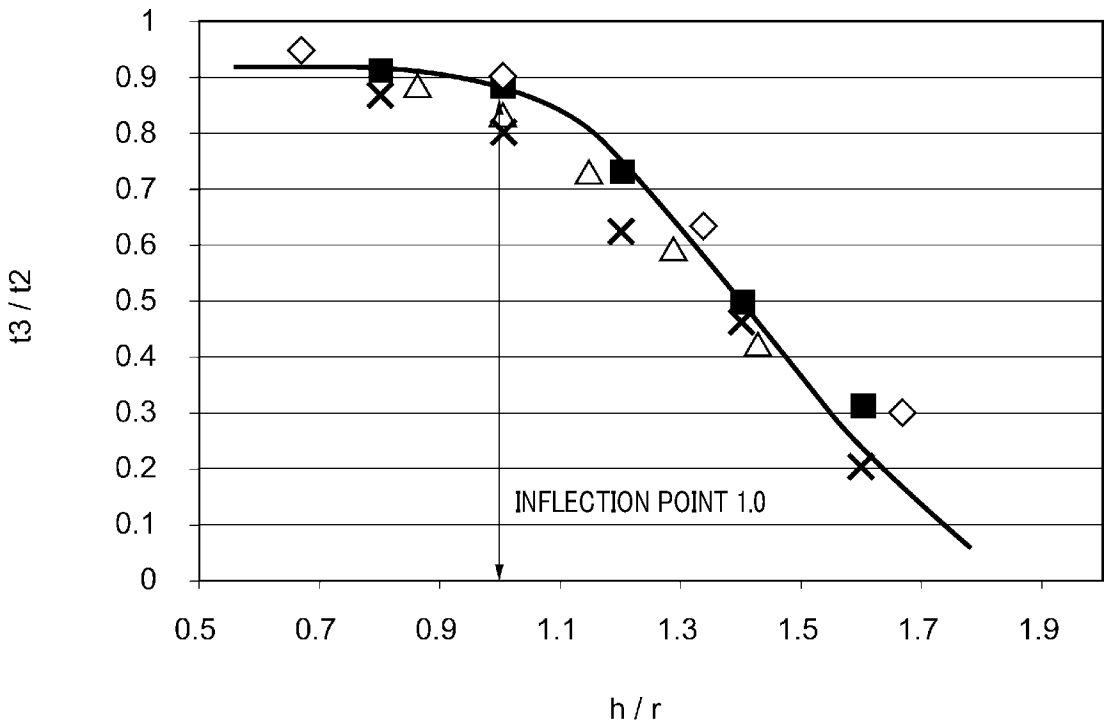
FIG. 7 is a diagram illustrating the ratio of maximum thickness and minimum thickness of the precious metal layer according to the extruded shape (the ratio between height and radius) of the convex portion.

FIG. 7 illustrates the results of the evaluation test. FIG. 7 provides the properties of the film thickness ratio t3/t2 according to the shape (h/r) of the convex portion 46. The lateral axis of FIG. 7 indicates h/r and the vertical axis of FIG. 7 indicates t3/t2. The results with h=0.3 mm are represented in a plot with white lozenges, the results with h=0.5 mm are represented in a plot with black squares, the results with h=0.7 mm are represented in a plot with triangles, and the results with h=1.0 mm are represented in a plot with symbols X. FIG. 7 also represents a characteristic curve formed by linear approximation of these plots.

As illustrated in FIG. 7, the characteristic curve has an inflexion point with h/r=1.0. That is, in a region with h/r smaller than 1.0, the film thickness ratio t3/t2 is stable around 0.9. On the other hand, when h/r is larger than 1.0, the film thickness ratio t3/t2 decreases at an almost constant rate according to the increase of h/r. That is, when h/r≤1.0 is satisfied, the uniformity of the thickness of the precious metal layer 60 is improved. In this manner, the results of the evaluation test illustrated in FIG. 7 have revealed that, when the shape of the convex portion 46 in the ground electrode 40 is set within the range of h/r≤1.0, the precious metal layer 60 has no extremely thin portion, which reduces the risk of exposure of the base material of the ground electrode 40.

Next, the grounds for setting the shape of the convex portion 46 of the ground electrode 40 within the range of h/r≤1.3 will be described with reference to FIG. 8. This condition is derived from the results of a consumption endurance test on the spark plug 100 under the following specifications:

- Thickness T of the base material of the ground electrode 40: fixed to 1.3 mm
- Width of the base material of the ground electrode 40 (the dimension as seen in the depth direction illustrated in FIG. 3): fixed to 2.6 mm
- Thickness t1 of the precious metal chip 60*a* before extrusion molding (see FIG. 4): fixed to 0.15 mm
- Diameter φ1 of the precious metal chip 60*a* before extrusion molding (see FIG. 4): fixed to 1.2 mm
- Height h of the convex portion 46: fixed to 0.5 mm
- Radius r of the convex portion 46: 12 different heights h/r of 0.5 to 1.6
- Maximum thickness t2 of the precious metal layer 60 after the extrusion molding: fixed to 0.15 mm At the consumption endurance test, first, in setting the push-in amounts H of the pressing jig 103 to ensure one of the foregoing heights h, 12 convex cavities 101 with different diameters were used to provide the 12 different radiuses r of the convex portion 46. That is, the convex portions 46 and the precious metal layers 60 were formed in one height h×12 radiuses r=the total of 12 settings.

The consumption endurance test was conducted using the thus formed convex portions 46 and precious metal layers 60 in the foregoing settings. At the consumption endurance test, the lifetime (hours) of the ground electrode 40 was measured when the spark plug 100 was discharged in an environment at a flow rate of 30 m/s corresponding to a future engine, in an atmosphere of 0.9 MPa, $N_2$, and in an ignition period of 30 Hz, and the measurement values were set as evaluation characteristic values. In this case, the lifetime refers to a time taken from the wearing out of the precious metal layer 60 on the surface of the convex portion 46 to the exposure of the base material of the ground electrode 40.

Figure 8:
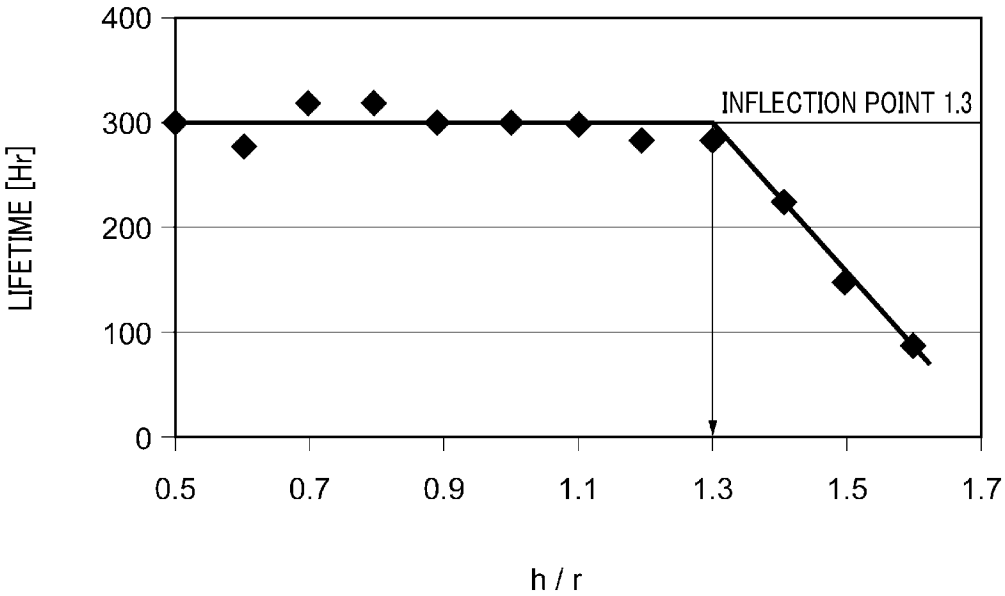
FIG. 8 is a diagram illustrating consumable life of the precious metal layer according to the extruded shape (the ratio between height and radius) of the convex portion.

FIG. 8 illustrates the results of the consumption endurance test. FIG. 8 provides the characteristics of the lifetime according to the shape (h/r) of the convex portion. The lateral axis of FIG. 8 indicates h/r and the vertical axis of FIG. 8 indicates lifetime. In FIG. 8, the values of lifetime measured under the foregoing conditions of h/r are plotted and these plots are connected by a line.

As illustrated in FIG. 8, the characteristic line has an inflexion point with h/r=1.3. That is, in a region with h/r smaller than 1.3, the lifetime is generally stabled around 300 hours. On the other hand, when h/r becomes larger than 1.3, the lifetime decreases at an almost constant rate according to the increase of h/r. That is, when h/r≤1.3 is satisfied, the lifetime of the ground electrode 40 can be preferably maintained. In this manner, the results of the evaluation test illustrated in FIG. 8 have revealed that setting the shape of the convex portion 46 in the ground electrode 40 is set within the range of h/r≤1.3 makes it possible to suppress the precious metal layer 60 in the ground electrode 40 from wearing and preferably prevent the exposure of the base material of the ground electrode 40.

Considering the results illustrated in FIGS. 7 and 8 in combination, the film thickness ratio t3/t2 starts to reduce in the range of 1.0≤h/r≤1.3 but the lifetime of the ground electrode 40 does not decrease. That is, in this range, the desired advantageous effect of suppressing the precious metal layer 60 in the ground electrode 40 from wearing can be produced even though the uniformity of the thickness of the precious metal layer 60 becomes deteriorated. The reason for occurrence of this state will be described with reference to FIGS. 9 and 10.

Figure 9:
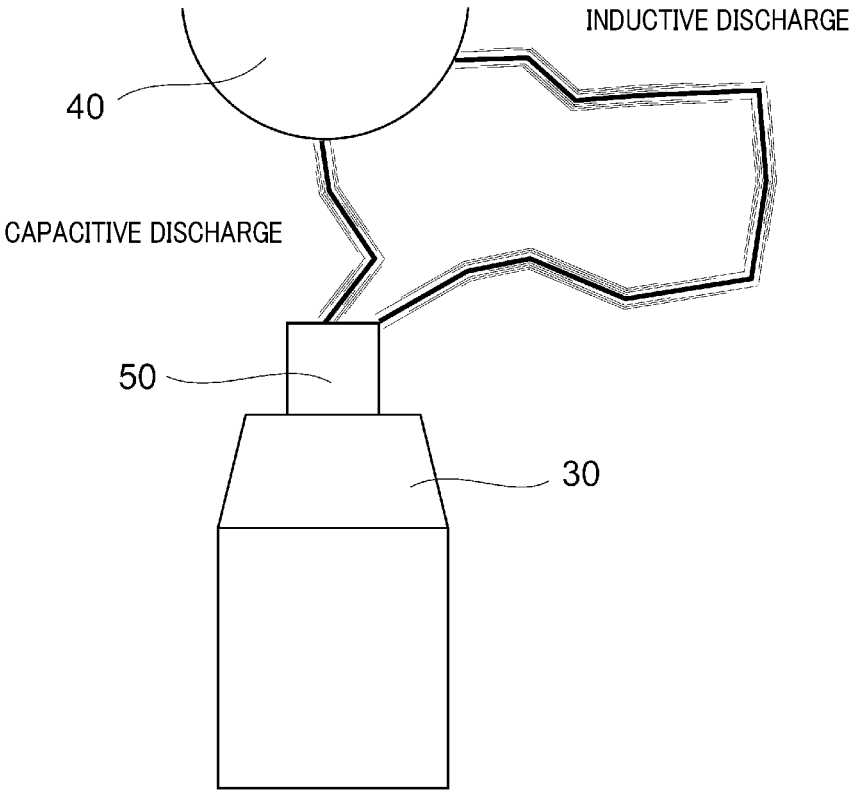
FIG. 9 is a schematic diagram for describing a discharge phenomenon occurring between a center electrode and the ground electrode.
Figure 10:
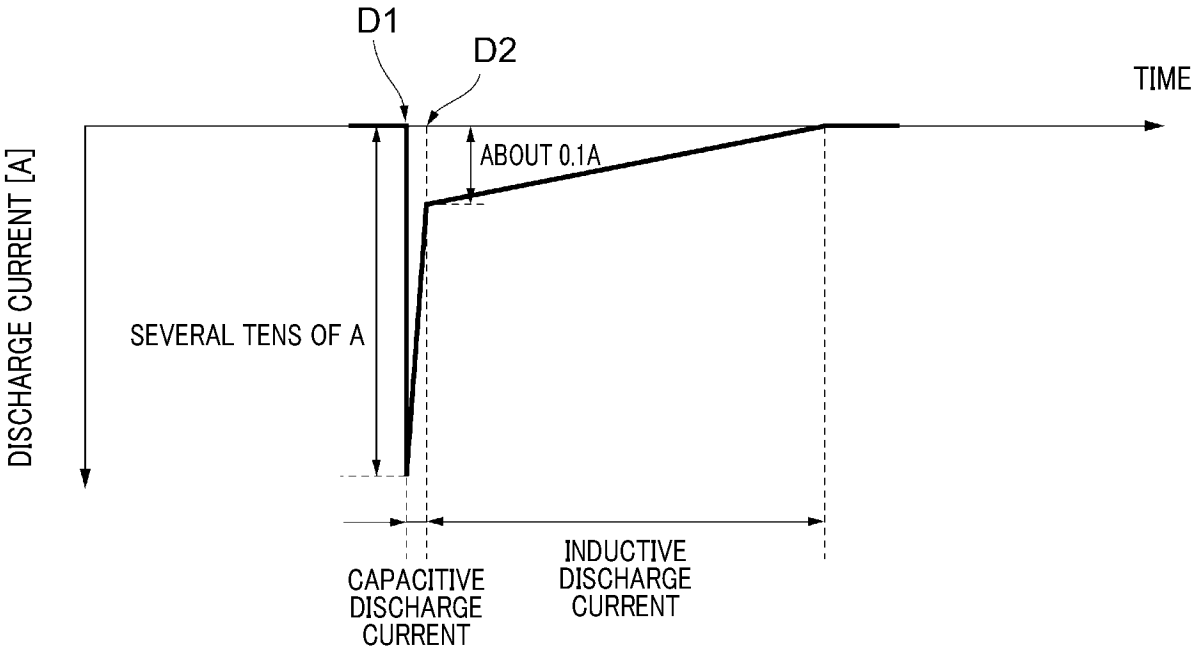
FIG. 10 is a diagram illustrating discharge current values of capacitive discharge and inductive discharge and respective occurrence timings of the discharges.

As illustrated in FIG. 9, there are two kinds of discharge between the center electrode 30 and the ground electrode 40 in the spark plug, that is, capacitive discharge and inductive discharge. The capacitive discharge more greatly contributes to the amount of electrode consumption than the inductive discharge. In other words, as illustrated in FIG. 10, the capacitive discharge current flowing between the electrodes due to capacitive discharge is about 100 times larger than the inductive discharge current flowing between the electrodes due to the inductive discharge. Accordingly, the progress of wear on the electrode surface due to capacitive discharge tends to be faster than that due to inductive discharge.

The capacitive discharge is likely to occur at the minimum gap portion between the electrodes. Accordingly, in the precious metal layer 60 on the ground electrode 40, the capacitive discharge first occurs at the tip portion (the portion with the maximum thickness t2), and the precious metal layer 60 starts to be consumed from the tip portion. With the progress of the wear on the tip portion, the minimum gap portion shifts to another place and the portion to be worn due to the capacitive discharge also shifts. That is, at the initial stage of the discharge, the portion of the precious metal layer 60 with the maximum thickness t2 is mainly consumed and the portion of the precious metal layer 60 with the minimum thickness t3 is hardly consumed. Accordingly, it is considered that, even when the uniformity of the film thickness ratio t3/t2 of the precious metal layer 60 becomes deteriorated to some degree, there is a region with the consumable life of the ground electrode 40 remaining unchanged ($1.0<h/r\leq1.3$)

The present embodiment has been described so far with reference to specific examples. However, the present disclosure is not limited to these specific examples. These specific examples to which a design change is added as appropriate by a person skilled in the art would also fall within the scope of the present disclosure as far as they include the features of the present disclosure. The elements of the specific examples described above and their arrangements, conditions, and shapes are not limited to those exemplified above but can be modified as appropriate. The elements of the specific examples described above can be appropriately changed in combination without any technical inconsistency.

Figure 11:
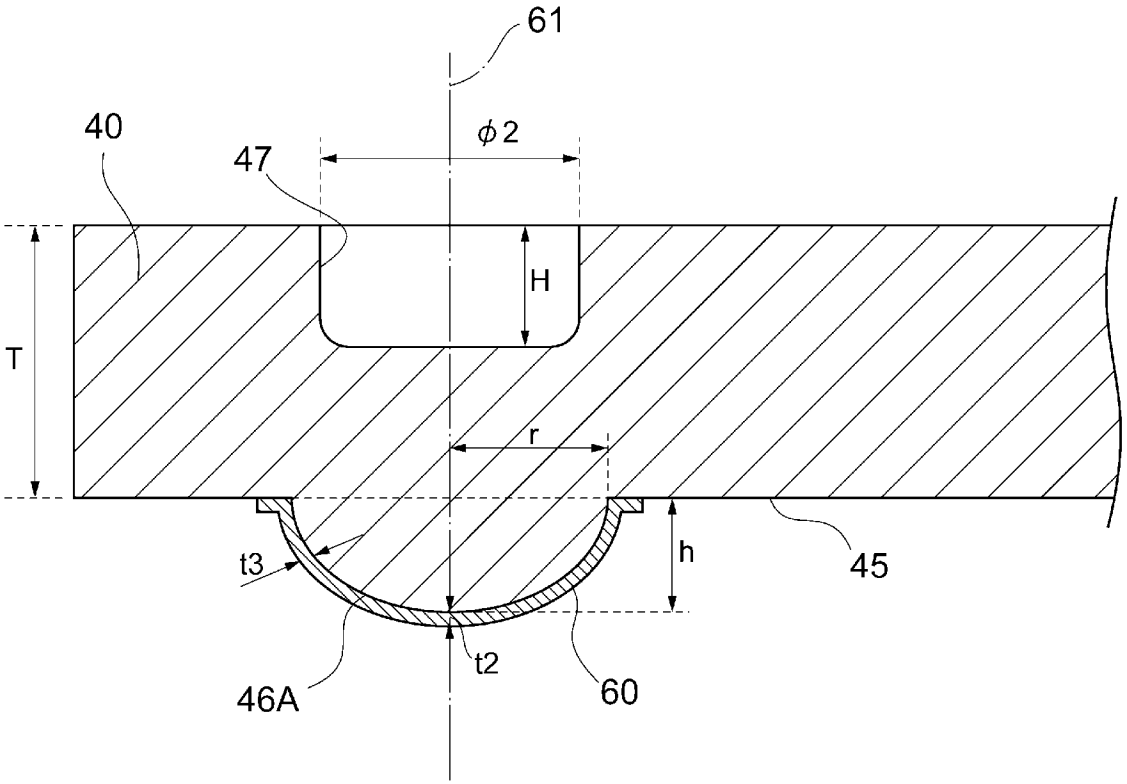
FIG. 11 is a cross-sectional view of another aspect of a convex portion of a ground electrode.
Figure 12:
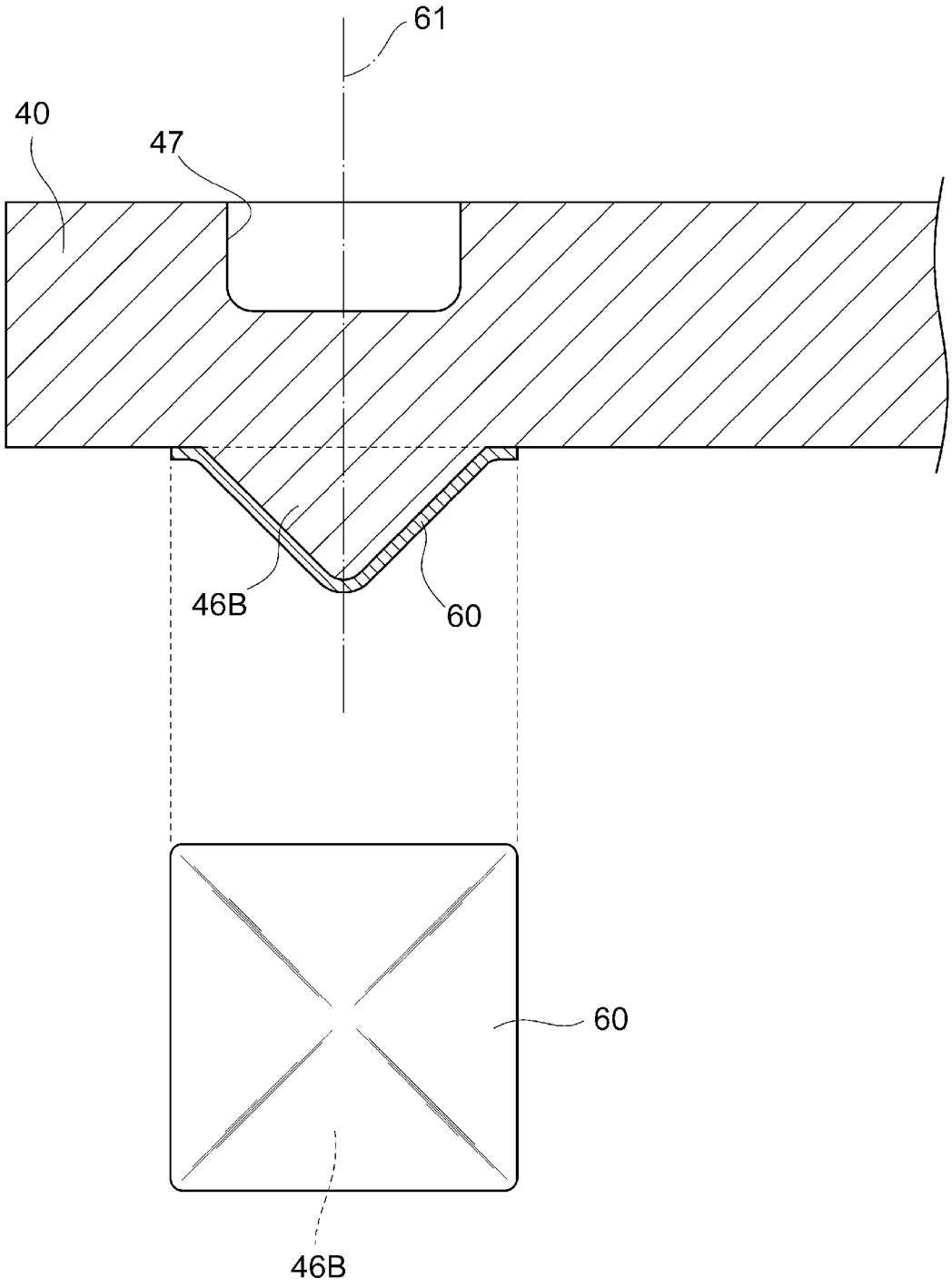
FIG. 12 is a cross-sectional view of yet another aspect of a convex portion of a ground electrode.

In the foregoing embodiment, the convex portion 46 of the ground electrode 40 is formed in a hemispheric shape. However, the convex portion 46 may have a shape other than a hemispheric shape as far as the surface is protruded outward and has surfaces without corners. For example, as illustrated in FIG. 11, a convex portion 46A of the ground electrode 40 may have a semi-oval spherical shape. Alternatively, as illustrated in FIG. 12, a convex portion 46B of the ground electrode 40 may have a pyramid shape such as a trigonal pyramid or a quadrangular pyramid with vertexes and sides rounded and curved.

In the foregoing embodiment, the precious metal layer 60 is applied to the entire surface of the convex portion 46 of the ground electrode 40 as an example. However, the precious metal layer 60 may not cover the entire surface of the convex portion but may be applied to at least a part of the convex portion 46 including the tip portion.

In the forgoing embodiment, at the formation of the precious metal layer 60, the precious metal chip 60*a* is welded to the base material of the ground electrode 40 and then subjected to extrusion molding. Alternatively, the precious metal chip 60*a* may be bonded to the ground electrode 40 by a method other than welding.

In the forgoing embodiment, the slant-shape ground electrode 40 is provided as an example. However, the spark plug 100 of the present embodiment is also applicable to a configuration of a general ground electrode with the tip portion shaped to be orthogonal to the axis 33 of the center electrode 30 and cover the tip portion of the center electrode 30.

After the formation of the convex portion 46 of the ground electrode 40 and the precious metal layer 60 by extrusion molding as in the foregoing embodiment, the tip portions of the convex portion 46 and the precious metal layer 60 may be further subjected to flattening processing to form a flat portion (flattening step). Even when the precious metal layer 60 is processed according to the procedure as described above, the thickness of the precious metal layer 60 is hardly influenced and the same advantageous effects as those of the foregoing embodiment can be obtained. As with the pyramid-shaped convex portion 46B described above, the convex portion 46 may be formed by extrusion molding in such a manner as to have a flat portion formed by flattening processing at the tip of the hemispheric shape and have a boundary line rounded and curved between the flat surface portion and the hemispheric surface.

What is claimed is:

1. A spark plug comprising:

a cylindrical mounting bracket attachable to an internal combustion engine;

a center electrode that is held by the mounting bracket in an insulated manner and has a first end portion exposed and extended from a first end portion of the mounting bracket;

a ground electrode that has a first end side joined to the first end portion of the mounting bracket and has a surface of a second end side extended to be opposed to the first end portion of the center electrode;

a convex portion that protrudes from a base material of the ground electrode on the surface of the ground electrode facing the center electrode, has a surface protruded outward, and has surfaces without corners;

a precious metal layer formed on the surface of the convex portion; and a shape of the convex portion satisfies $h/r\leq1.3$ where h represents a height of the ground electrode from the surface to the convex portion as seen in a protrusion direction, and r represents a maximum length from a center of gravity to an edge end of a cross section of the convex portion on the surface, wherein a tip of the convex portion of the ground electrode has a hemispheric shape.

2. The spark plug according to claim 1, wherein the shape of the convex portion satisfies $h/r\leq1.0$.

3. The spark plug according to claim 1, wherein the convex portion is formed by protruding part of the base material of the ground electrode by extrusion molding, and the precious metal layer is welded to the surface of the ground electrode and then formed by extrusion molding on the entire surface of the convex portion.

4. The spark plug according to claim 1, wherein the precious metal layer is formed to satisfy $t3/t2\geq0.6$ where t2 represents a thickness of the precious metal layer in a minimum gap portion between the convex portion of the ground electrode and the center electrode, and t3 represents a minimum thickness of the precious metal layer.

5. A method for manufacturing a spark plug, the spark plug including:

a cylindrical mounting bracket attachable to an internal combustion engine;

a center electrode that is held by the mounting bracket in an insulated manner and has a first end portion exposed and extended from a first end portion of the mounting bracket; and a ground electrode that has a first end side joined to the first end portion of the mounting bracket and has a surface of the second end side extended to be opposed to the first end portion of the center electrode, wherein the method comprising:

a convex portion forming step of forming a convex portion that protrudes from a base material of the ground electrode on the surface of the ground electrode toward the center electrode, has a surface protruded outward, and has surfaces without corners;

a precious metal layer forming step of forming a precious metal layer on the surface of the convex portion;

in the convex portion forming step, the convex portion is formed by protruding part of the base material of the ground electrode by extrusion molding, before the convex portion forming step, a bonding step of bonding the precious metal layer to the surface of the ground electrode is included, and in the precious metal layer forming step, the extrusion molding in the convex portion forming step is performed while the precious metal layer is welded in the bonding step to form the precious metal layer on the entire surface of the convex portion, wherein a tip of the convex portion of the ground electrode has a hemispheric shape.

6. The method for manufacturing a spark plug according to claim 5, wherein in the convex portion forming step, the extrusion molding is performed such that an axis of a metal die for the extrusion molding and an axis of the convex portion to be formed align with each other.

7. The method for manufacturing a spark plug according to claim 5, the method comprising, after the precious metal layer forming step, a flattening step of performing flattening processing the convex portion formed on the surface of the ground electrode and the tip portion of the precious metal layer formed on the surface of the convex portion to form a flat portion.

* * * * *